US007596347B2

(12) United States Patent
Dräger et al.

(10) Patent No.: US 7,596,347 B2
(45) Date of Patent: Sep. 29, 2009

(54) SEPARATING AGENT FOR USE IN A FUSER MECHANISM

(75) Inventors: Udo Dräger, Speyer (DE); Detlef Schulze-Hagenest, Molfsee (DE); Cumar Sreekumar, Penfield, NY (US); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/014,140

(22) Filed: Jan. 15, 2008

(65) Prior Publication Data

US 2008/0112735 A1 May 15, 2008

Related U.S. Application Data

(62) Division of application No. 11/038,715, filed on Jan. 20, 2005, now abandoned.

(51) Int. Cl.
*G03G 15/20* (2006.01)

(52) U.S. Cl. ..... 399/325

(58) Field of Classification Search ..... 399/325
See application file for complete search history.

(56) References Cited

U.S. PATENT DOCUMENTS 6,084,049 A * 7/2000 Beach et al. ..... 399/106
2004/0120736 A1* 6/2004 Kowalski ..... 399/325

OTHER PUBLICATIONS

Derwent Abstract of US Pat. No. 6,084,049.*

* cited by examiner

*Primary Examiner*—David M Gray
*Assistant Examiner*—Ryan D Walsh
(74) *Attorney, Agent, or Firm*—Carl F. Ruoff; Andrew J. Anderson

(57) ABSTRACT

A separating agent, in particular silicon oil, applied to the surface of a fuser mechanism, preferably in an electrophotographic printing machine. Contamination of the surfaces of the printing media is substantially prevented or reduced when the separating agent is diluted with at least one solvent with a boiling point equal to or greater than 60° C., preferably equal to or greater than 100° C., but below 160° C.

11 Claims, 1 Drawing Sheet

SEPARATING AGENT FOR USE IN A FUSER MECHANISM

CROSS-REFERENCE TO RELATED APPLICATIONS

This is a divisional of application Ser. No. 11/038,715, filed Jan. 20, 2005 now abandoned.

FIELD OF THE INVENTION

The invention relates to a separating agent, in particular silicon oil, for application to the surface of a fuser mechanism, preferably in an electrophotographic printing machine.

BACKGROUND OF THE INVENTION

In copiers and printing machines, in particular in electrophotographic printing machines, toner from inking devices is applied to a printing medium for the purpose of generating on the printing medium an ultimate image that corresponds to the data provided for the desired image. In order to avoid smearing of the toner on the printing medium the toner is generally fused by simultaneously applying pressure and heat to the surface of the printing medium.

For this purpose fuser mechanisms are used, which can contain the various fuser elements. In most cases these mechanisms contain a fuser roller and a pressure roller that is located across a printing medium transport path from the fuser roller. The path traveled by the printing medium leads between the fuser roller and the pressure roller through the so-called nip. The fuser roller is heated for the fusing process and the pressure roller is pressed against the fuser roller. This enables the toner to melt and ultimately to fuse onto the surface of the printing medium. It is also possible that the two fusing elements, i.e., the fuser roller and the pressure roller, are identically formed and that both are heated.

To allow the printing medium to pass smoothly through the nip, the fuser roller and the pressure roller each rotate in the printing medium's direction of travel. A problem arises in this process at the moment when the printing medium on which the toner layer has been fused is supposed to separate from the fuser roller. At that moment toner offset can occur, whereby same toner detaches itself from the printing medium and becomes attached to the surface of the fuser roller. The resulting image is then severely adversely affected and the fuser roller becomes contaminated.

Separating agents are used to solve the problem. Separating agents characteristically reduce the bond between the surface of the toner and the fuser roller, so that such bond is out-weighed by the bond between the toner and the printing medium. Accordingly, offset is substantially prevented. Silicon oil is the main choice among the separating agents in use. It is applied to the surface of the fuser roller on the upstream side of the nip. For this purpose coating rollers, for example, are used to apply the silicon oil.

Once the separating agent is on the fuser roller, it must be sufficiently viscous so that it remains on the surface of the fuser roller during the fusing process and does not become transferred to the printing medium. During his time the viscosity of the separating agent is a function of the temperature. Thus, if the silicon oil must be maintained at a certain viscosity on the surface of the heated fuser roller, its viscosity at room temperature must be significantly higher. Because of the resultant high viscosity of the "cold" separating agent, the problem arises that the separating agent does not spread out homogeneously in a thin layer, for example, when being transferred from the coating roller to the surface of the fuser roller. The result is that the distribution of the separating agent on the surface is non-homogeneous so that streaks appear on the image gloss.

What proves to be an even more persistent and unpleasant problem arises, however, when surplus separating agent makes its way into the interior of the printing machine and then reaches the inking device. For example, when duplex printing is in progress, the upper sides of the printing medium, on which the separating agent is present, lie on the surface of whatever conveying medium is being used. This conveyor can, for example, be a belt. At least some of the separating agent can remain on this conveyor belt and can then contaminate the bottom side of subsequently conveyed printing media, or can even go directly into the inking devices.

The pressure roller, too, can become covered with separating agent by contact with the fuser roller. Here, too, the bottom side of the printing media can thus become contaminated. If the bottom side of printing media is contaminated with separating agent, what can often happen in accordance with what has been said above, is that in the course of duplex printing the bottom side of printing medium comes into contact with the inking devices, and then the inking devices become contaminated.

Once separating agent is in or on an inking device, the transfer characteristics of the inking device change. Depending upon the amount of the separating agent that is present, varying changes in the rate of toner transfer onto the printing medium occur. This can also occur as soon as separating agent is present in the area between the printing medium and the inking device. For such changes to occur, it is not absolutely necessary that the separating agent get into the inking device. It has been shown that the dependence of the transfer characteristic of the inking device upon the amount of the separating agent present in this area is, at least with respect to the use of the standardly used silicon oils, not linear. As the silicon oil begins to enter the inking device, the amount of toner transferred increases at first, and then as more oil enters the inking device a maximum is reached, which is then exceeded. In any case, the amount of toner always deviates from the desired amount, and the deviation differs from place to place in the inking device, depending upon the amount of the silicon oil present. But even if the transfer characteristics of the inking devices vary linearly as a function of the amount of separating agent present, highly noticeable changes in the amount of toner on the printing medium as a function of the separating agent present occur.

In duplex printing, a non-homogeneous distribution of silicon oil on the surface of the printing medium can exist when the second side is printed. This non-homogeneous distribution of silicon oil is based mainly on the fact that the viscosity of the silicon oil is very high at room temperature, and an even application of silicon oil with this viscosity is essentially impossible. This lack of homogeneity leads to the inking devices having varying transfer characteristics as they transfer toner onto the surface of the printing medium, and thus to the resulting image, displaying noticeable streaks.

Aside from the fact that a complete and even application of separating agent onto the surface of fuser roller is not possible, in all cases at least enough separating agent must be transferred to the surface so that the printing medium, across its entire width and together with the total toner layer, separates from the fuser roller without offset. Thus, at least a minimal amount of separating agent is always necessary. Because of the non-homogeneous application of the separating agent there are always areas of on the surface of the printing medium that are contaminated with the separating agent. This permits separating agent to be carried into the printing machine.

One way of preventing separating agent from being carried into the printing machine is to free at least the surface of the pressure roller from residual separating agent. For this purpose, it is suggested, for example, that blades be used for scraping the separating agent off the surface of the pressure roller. Of course, one is confronted here, too, with conflicting interests. That is to say, one may want to leave at least a small amount of separating agent on this surface so that the printing medium will separate from the pressure roller with the greatest possible ease. In addition, when a blade is used, it is not possible to completely clean off the pressure roller. There will always be a residue of separating agent on the surface of the pressure roller, which can then reach the interior of the printing machine by way of a printing medium.

SUMMARY OF THE INVENTION

The purpose of the subject invention is, therefore, to improve the quality of a printed image by preventing the introduction of separating agent on the printing medium into the printing machine. The object of the invention is achieved when the separating agent is diluted with at least one solvent having a boiling point equal to or greater than 60° C., preferably equal to or greater than 100° C. By the use of at least one solvent, the viscosity of the separating agent is advantageously reduced to the extent that it can be applied easily and evenly in thin layers, and can also be applied to the fusing element with a coating roller. The fusing element can, for example, be a fuser roller or a corresponding pressure roller.

Figure 1:
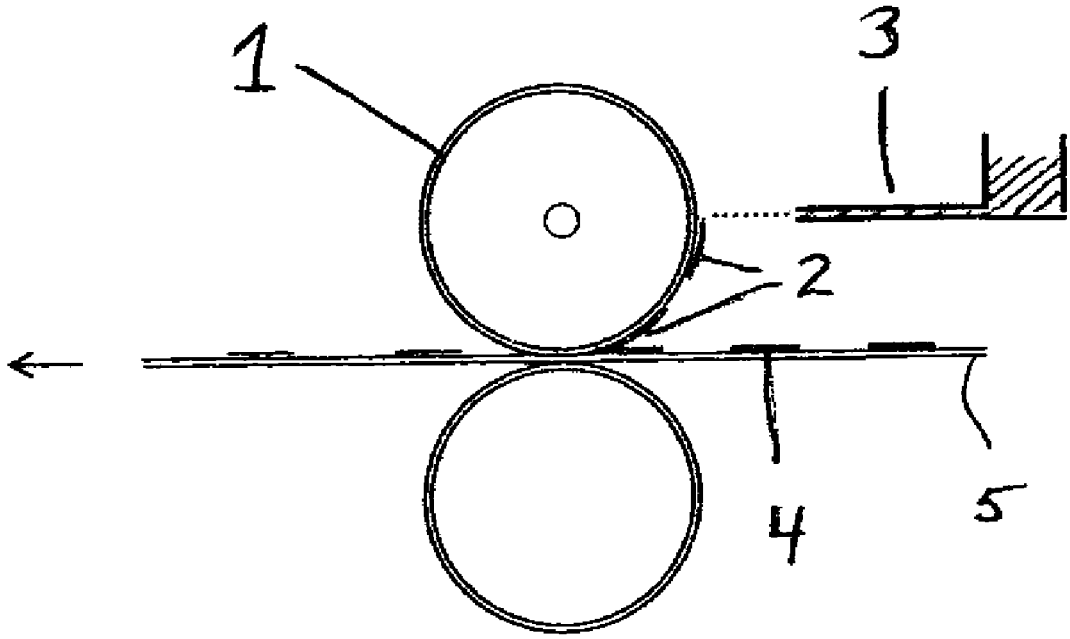
FIG. 1 is a schematic illustration of a fuser mechanism employable in accordance with an embodiment the present invention.

The surface temperature of the fusing roller is usually about 160° C. It is advantageously assured that, at room temperature or even within a noticeable range in excess thereof, the at least one solvent with the proposed boiling point temperature will be present in the separating agent in sufficient quantity to influence the viscosity in a positive manner. If the separating agent is then applied to the surface of the heated fuser element, the at least one solvent evaporates out of the separating agent to such an extent that the viscosity is no longer affected by the solvent and is dependent solely upon the separating agent in use. Because the viscosity of the separating agent is already reduced due to the temperature on the surface of fuser element, the resulting viscosity is fully sufficient, in and of itself, to prevent a toner offset, and if the solvent were still present at this point, this characteristic of the separating agent would be more likely to deteriorate, because the viscosity would be decreased too much. The purpose of the separating agent is to cause the toner to detach itself easily from the surface of the fusing element, and for this purpose the separating agent must have a viscosity that is lower than that of the toner. If the viscosity of the separating agent is, however, too low, it can more easily happen that it detaches itself from the fuser element and ends up on the printing medium, where it causes the disadvantages with respect to printer quality described above.

Alternatively, more than one solvent, having varying boiling points, may be used to thin the separating agent is expressly included herein. In this way it can be advantageously possible for the temperature dependency of the mixture of separating agent and solvents to be adapted to the prevailing circumstances. It is, in particular, possible that at each point in time while the temperature of the surface of the fuser element is being raised, the viscosity of the separating agent remains essentially constant. This can make an especially even distribution of separating agent on the surface of the fuser element even more possible.

The invention is additionally achieved by a separating agent that is mixed with at least one solvent that has a boiling point equal to or greater than 60° C., being preferably equal to or greater than 100° C., but under 160° C.

The invention, and its objects and advantages, will become more apparent in the detailed description of the preferred embodiment presented below

DETAILED DESCRIPTION OF THE INVENTION

According to the invention, the at least one solvent for the fuser device separating agent belongs to one of the following groups or their derivatives: THF, toluene, ethyl acetate, butyl acetate, propylene acetate, methylethylketone, Hexane, chlorbenzol, dichlormethane or 111 tichlorethane. Advantageously this solvent and its derivatives have characteristics such that they mix well with separating agents and have suitable boiling points within the required range. In a particularly advantageous embodiment, provision is made for the solvent to have halogens.

Because of transfers of electrical charge during the electrophotographic printing process ozone is released inside the printing machine. This ozone reacts advantageously with the vaporized solvents that contain halogen. This reactive mixture can then be easily removed from the printing machine by a ventilating blower, and may, for example, be passed through a carbon filter.

In a further development, provision is made for the separating agent to be diluted such that a viscosity is obtained that is suitable for applying the separating agent to the surface of the fuser roller. In this way, depending upon the application mechanism or element used, such as a coating roller or spray nozzles, an ideal viscosity can be achieved.

In a particularly advantageous embodiment, provision is made for the viscosity of the diluted separating agent to be less than 20%, preferably equal to or less than 18% of that of the undiluted separating agent. The viscosity of silicon oil at a temperature that approximates that of the heated surface of a fuser roller is approximately 18% of the viscosity of the silicon oil at room temperature. Thus, in this embodiment according to the invention the viscosity on the surface of the fuser element is not reduced. The separating agent can then be homogeneously distributed on the surface of the fuser roller.

It is even possible that one would want the viscosity of the separating agent, before it is applied to the fuser element, to be lower than when it is at the fuser temperature. This can, for example, be the case when the separating agent is sprayed or squirted through jets onto the surface of the fuser element. Consequently, provision is made in an advantageous further development of the invention for the viscosity of the diluted separating agent to be equal to or less than 20 cSt. This viscosity is particularly well suitable for applying a separating agent to the surface of a fuser element by a spray mechanism similar to an ink jet mechanism.

In an alternative embodiment, provision is further made for the diluted separating agent to contain more than 20% by volume of solvent. This concentration has been shown by experimentation to be sufficient so that the viscosity of the heated silicon oil is essentially equal to or less than the viscosity of the diluted silicon oil at room temperature. In this range of dilution, the viscosity achieved is, within limits, independent of the solvent that is used. The achieved viscosity differs then by just a few percentage points from the viscosity of the heated silicon oil.

In an advantageous extension of this embodiment, provision is made for the separating agent to contain between 50% and 75% by volume of solvent. Mainly, then, the separating agent has a viscosity that is suitable for application be a spraying mechanism. The precise percent by volume can then be a function of the separating agent used. For example, silicon oils with a viscosity of 350 cSt or 1000 cSt have, when diluted 50% or 75% respectively, approximately the same viscosity as is necessary for spraying the separating agent onto the surface of the fuser element using, for example, a piezoelectric process.

It is possible for the surface of the fuser element to have a temperature at which the solvent does not boil. Consequently, in such a case the solvent remains on the fuser element surface and can influence the characteristics of the separating agent such as to prevent toner offset.

The temperature of the surface of a pressure roller can, for example, remain within such a temperature range, or a fuser roller can be adjusted to have a relatively low fusing temperature. Thus, in a further embodiment according to the invention, provision is made for the surface of the fuser element to be heated to a temperature that is above the boiling point of the at least one solvent contained in the diluted separating agent. Provision can thereby be made for the surface of the pressure roller and/or the fuser roller to be heated up to a commensurate temperature.

In an advantageous further embodiment of the process according to the invention, provision is further made for the diluted separating agent to be applied point by point to the surface of the fuser element, preferably to those areas that come into contact with areas on the printing medium where toner is present. In this way one can be assured of a homogeneous layer of separating agent on the surface of the fuser element. It is possible, in particular, that no separating agent be applied to those areas on the surface that do not come into contact with toner. The result is that just these areas of the printing medium remain free of separating agent. Otherwise, if the separating agent is on this surface, the result can be that the ability of the printing medium to absorb color or ink would at least be diminished, so that writing, painting, or even later printing on these areas of the printing medium would at the least be inhibited. These surfaces can then, for example, be more easily written on later. This can, for example be advantageous for writing notes on printing media that have already been imprinted with images.

In an extension, provision is made for applying the diluted separating agent point by point by an ink jet mechanism. These spray mechanisms are well known in prior art and they are able to apply diluted separating agent very precisely and homogeneously onto the surface of the fuser element Because of the high viscosity, undiluted separating agent cannot, at least not at room temperature, be applied by such mechanisms. From a practical standpoint, it is not expected that significant structural changes to conventional jet mechanisms will be made because of the use of diluted separating agent according to the invention. FIG. 1 is a schematic illustration of such a fuser mechanism embodiment employable in accordance with the present invention, wherein diluted separating agent 2 is applied point by point onto the surface of fuser element 1 by ink jet mechanism 3, where the applied diluted separating agent comes into contact with toner 4 present on areas of a printing medium 5.

In a further development according to the invention, provision is made for the amount of diluted separating agent to be varied as a function of the amount of toner that is present on those areas of the printing medium to which toner has been applied. This development allows less separating agent to be applied to precisely those areas of a printing medium that have little toner. Otherwise, more superfluous separating agent will be present in these areas than in areas with more toner. Such non-homogeneously distributed separating agent can than get into the inking device as the result of negative pressure, and cause streaks.

EXAMPLE 1

Silicon oil with a viscosity of 1000 cSt is used as the separating agent. Such silicon oils can be obtained from, for example, Wacker Silicon Oil AK. This silicon oil is then mixed with 75% by volume of solvent. Toluene is used as the solvent. The viscosity of the separating agent is thereby reduced to a viscosity that is below or equal to 20 cSt at 25° C.

The separating agent is then filled into a piezoelectric mechanism, such as those conventionally used in ink jet processes. Additional heating of the separating agent in order to make application possible is no longer necessary in this situation.

It is already known, from the data that are used for the creation of a printed image on the printing medium, which areas of the fuser roller that is used to fuse the toner on the printing medium come into contact with toner. Using this data, the separating agent can be selectively sprayed onto these areas of the fuser roller that come into contact with toner. The separating agent can, however, simply be applied to the entire surface of the fuser roller. If this is done, other application mechanisms can be used, such as, for example, a coating roller.

The surface of the fuser roller is covered with a homogeneous layer of separating agent. Because the temperature of the fuser roller is at approximately 160° C., and because the boiling point of toluene is 111° C., almost all of the toluene evaporates. The viscosity of the silicon oil on the surface of the fuser roller is now about 180 cSt. The amount of oil that is applied is adjusted such that even when the maximum amount of toner is on the printing medium, toner offset is prevented.

The evaporated solvent reacts inside the printing machine with the ozone that has resulted from corona arcing. The reactive mixture is removed from the interior of the printing machine by a blower and passed through a carbon filter that removes it from the air.

EXAMPLE 2

Silicon oil with a viscosity of 350 cSt is used as the separating agent. Such silicon oils can be obtained from, for example, Wacker Silicon Oil AK. This silicon oil is then mixed with 20% by volume of solvent. Toluene is used as the solvent. The viscosity of the separating agent is thereby reduced to a viscosity that is equal to or below 65 cSt at 25° C. The viscosity of the diluted separating agent at 25° C. approximately corresponds then to the viscosity at 160° C.

The separating agent is then applied to the fuser roller by a coating roller. The surface of the fuser roller is covered with a homogeneous layer of separating agent. Because the temperature of the fuser roller is at approximately 160° C., and because the boiling point of toluene is 111° C., almost all of the toluene evaporates. The viscosity of the silicon oil on the surface of the fuser roller is now about 65 cSt. The amount of oil that is applied is adjusted such that, even when the maximum amount of toner is on the printing medium, toner offset is prevented. The evaporated solvent reacts inside the printing machine with the ozone that has resulted from corona arcing. The reactive mixture is removed from the interior of the printing machine by means of a blower and passed through a carbon filter that removes it from the air.

In the main, other separating agents can also be used in the described manner. The separating agents are usually selected such that their viscosity is lower than that of the toner being used, but not so low that the separating agent detaches itself too easily from the surface of the fuser roller and accumulates on the printing medium. Therefore, in general, a separating agent is selected that has a viscosity that is just below that of the toner being used.

The invention has been described in detail with particular reference to certain preferred embodiments thereof, but it will be understood that variations and modifications can be effected within the spirit and scope of the invention.

The invention claimed is:

1. A process for applying a separating agent to a surface of a fuser element, comprising diluting the separating agent by mixing at least one solvent, that has a boiling point equal to or greater than 100° C., but less than 160° C., with the separating agent, and applying the resulting diluted separating agent to the fuser element surface, wherein the surface of the fuser element is heated up to a temperature that is above the boiling point of the at least one solvent contained in the diluted separating agent wherein the diluted separating agent contains between 50% and 75% by volume of said at least one solvent.

2. The process according to claim 1, wherein the diluted separating agent is applied point by point onto the surface of the fuser element.

3. The process according to claim 2, wherein the point-by-point application of diluted separating agent is done by the use of an ink jet mechanism.

4. The process according to claim 3, wherein the amount of diluted separating agent is varied as a function of the amount of toner that is present on areas of a printing medium to which toner has been applied.

5. The process according to claim 1, wherein said at least one solvent consists of one or more of the following solvents toluene, butyl acetate, propylene acetate, or chlorbenzol.

6. The process according to claim 1, wherein the separating agent contains silicon oil.

7. The process according to claim 6, wherein the fuser element is in a printing machine.

8. The process according to claim 7, wherein the diluted separating agent is applied point by point onto the surface of the fuser element.

9. The process according to claim 8, wherein the point-by-point application of diluted separating agent is done by the use of an ink jet mechanism.

10. The process according to claim 9, wherein the amount of diluted separating agent is varied as a function of the amount of toner that is present on areas of a printing medium to which toner has been applied.

11. The process according to claim 7, wherein said at least one solvent consists of one or more of the following solvents toluene, butyl acetate, propylene acetate, or chlorbenzol.

* * * * *